US010001033B2

(12) United States Patent
Takenaka et al.

(10) Patent No.: US 10,001,033 B2
(45) Date of Patent: Jun. 19, 2018

(54) CYLINDER HEAD

(71) Applicant: Toyota Jidosha Kabushiki Kaisha, Toyota-shi (JP)

(72) Inventors: Kazunari Takenaka, Toyota (JP); Yukinori Ohta, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 114 days.

(21) Appl. No.: 14/832,174

(22) Filed: Aug. 21, 2015

(65) Prior Publication Data

US 2016/0061141 A1 Mar. 3, 2016

(30) Foreign Application Priority Data

Aug. 29, 2014 (JP) ..... 2014-175433

(51) Int. Cl.

| | |
|---|---|
| ***F02B 77/04*** | (2006.01) |
| ***F01L 1/053*** | (2006.01) |
| ***F02F 1/24*** | (2006.01) |
| *F01L 1/047* | (2006.01) |

(52) U.S. Cl.

CPC ..... *F01L 1/053* (2013.01); *F02F 1/24* (2013.01); *F01L 2001/0476* (2013.01); *F01L 2001/0537* (2013.01)

(58) Field of Classification Search

CPC ..... F01L 1/053; F01L 2001/0476; F01L 2001/0537; F02F 1/24; F02F 1/4285

USPC ..... 123/142.5 R, 195 H, 672, 308, 41.82 R

See application file for complete search history.

(56) References Cited

U.S. PATENT DOCUMENTS

| | | | | |
|---|---|---|---|---|
| 4,660,527 | A * | 4/1987 | Tanaka | F01L 1/0532 123/193.5 |
| 6,581,720 | B1 * | 6/2003 | Chen | F01N 13/102 181/198 |
| 2003/0024299 | A1 | 2/2003 | Fujita et al. | |
| 2005/0193726 | A1 * | 9/2005 | Funakoshi | F01N 3/08 60/323 |
| 2009/0013958 | A1 * | 1/2009 | Kumagai | F01L 1/053 123/195 H |
| 2010/0192887 | A1 * | 8/2010 | Iwata | F01L 1/022 123/90.17 |

FOREIGN PATENT DOCUMENTS

| | | | |
|---|---|---|---|
| CN | 101371011 | A | 2/2009 |
| JP | 8-210150 | A | 8/1996 |
| JP | 4365373 | | 11/2009 |
| JP | 2010-19124 | | 1/2010 |
| KR | 10-2012-0032346 | A | 4/2012 |
| WO | WO 2007/083222 | A1 | 7/2007 |

* cited by examiner

*Primary Examiner* — Syed O Hasan

(74) *Attorney, Agent, or Firm* — Oblon, McClelland, Maier & Neustadt, L.L.P.

(57) ABSTRACT

A cylinder head includes a pair of side walls extending along a cylinder arrangement direction, a connection wall that is provided between the pair of side walls and connects both of the side walls with each other, a bearing part provided in the connection wall, an intake port that is open in one side wall out of the pair of side walls, and an exhaust port that is open in the other side wall. The other side wall is provided with a protrusion part that projects from the other side wall, extends along the cylinder arrangement direction, and has a confronting surface that faces an exhaust pipe connected with the other side wall.

7 Claims, 6 Drawing Sheets

CYLINDER HEAD

INCORPORATION BY REFERENCE

The disclosure of Japanese Patent Application No. 2014-175433 filed on Aug. 29, 2014 including the specification, drawings and abstract is incorporated herein by reference in its entirety.

BACKGROUND OF THE INVENTION

1. Field of the Invention

The invention relates to a cylinder head of an internal combustion engine.

2. Description of Related Art

As a cylinder head of an internal combustion engine, a cylinder head is known, which includes a cylinder head body and a cam housing fixed to an upper part of the cylinder head body (for example, see Japanese Patent No. 4365373).

In a cylinder head described in Japanese Patent No. 4365373, a cam housing is provided with lower bearing parts. By coupling upper bearing parts, which are formed integrally with a cylinder head cover, to the lower bearing parts, circular journal holes are formed, and the journal holes support cam shafts so that the cam shafts are able to rotate. Lubricating oil for lubricating the cam shafts is supplied to the journal holes.

SUMMARY OF THE INVENTION

As temperature of lubricating oil for lubricating cam shafts decreases, the viscosity of the lubricating oil becomes higher. Therefore, when an internal combustion engine is not warmed up sufficiently, frictional resistance that occurs when the cam shafts rotate (herein after, referred to as cam friction) increases.

Especially in recent years, hybrid vehicles having internal combustion engines and motors as driving sources have come into practical use, and such a hybrid vehicle is sometimes driven only by a motor when an internal combustion engine is stopped. Therefore, a period of stoppage of an internal combustion engine has become longer, and temperature of an internal combustion engine tends to decrease.

Therefore, in a vehicle having an internal combustion engine, in terms of improvement of fuel efficiency, it is desired to reduce cam friction by swiftly increasing temperature of the internal combustion engine, or temperature of a cylinder head, so as to reduce viscosity of lubricating oil supplied to bearing parts.

The invention provides a cylinder head that is able to increase temperature of a bearing part swiftly.

A cylinder head according to an aspect of the invention includes a pair of side walls extending along a cylinder arrangement direction, a connection wall that is provided between the pair of side walls and connects both of the side walls with each other, a bearing part that is provided in the connection wall and supports a cam shaft so that the cam shaft is able to rotate, an intake port that is open in one side wall out of the pair of side walls, and an exhaust port that is open in the other side wall. The other side wall is provided with a protrusion part, which projects from the other side wall, extends along the cylinder arrangement direction, and has a confronting surface that faces an exhaust pipe connected with the other side wall.

According to the above aspect, since the confronting surface of the protrusion part faces the exhaust pipe, the protrusion part is also able to receive radiant heat from the exhaust pipe. Therefore, quantity of heat received is increased compared to a cylinder head without the protrusion part. Further, since the bearing part and the other side wall are connected with each other through the connection wall, heat received by the protrusion part, which is provided on the other side wall, is easily transferred to the bearing part. Therefore, it is possible to swiftly increase temperature of the bearing part provided in the cylinder head. Accordingly, temperature of lubricating oil supplied to the bearing part is increased, and viscosity of the lubricating oil is thus decreased. Hence, it is possible to reduce cam friction.

In the foregoing aspect, the cylinder head may include a cylinder head body and a cam housing that is fixed to an upper part of the cylinder head body. The other side wall may include a body side wall, which is a side wall of the cylinder head body, and a housing side wall, which is a side wall of the cam housing. The bearing part may be provided in the connection wall provided in the cam housing, and the exhaust port may be open in the body side wall. The protrusion part may be provided in the housing side wall.

In the above structure, the protrusion part is provided in the housing side wall, which is a side wall of the cam housing having the bearing part. Therefore, a distance between the protrusion part, which receives radiant heat, and the bearing part becomes shorter compared to that in the case where the protrusion part is provided in the body side wall. Therefore, with the above structure, it is possible to even more swiftly increase temperature of the bearing part provided in the cam housing, thereby reducing cam friction.

In the foregoing aspect, the protrusion part may be formed in an upper end of the other side wall. When manufacturing the cylinder head, there are instances where polishing is performed along an edge of an upper surface of the cylinder head to remove burr formed on the upper surface.

With the above structure, the protrusion part is provided in the upper end of the other side wall, and an upper surface of the side wall and an upper surface of the protrusion part become a continuous surface. Therefore, by performing deburring along the edge of the upper surface as stated above, deburring of the protrusion part is also performed simultaneously. Therefore, it is possible to prevent manufacturing man-hours from increasing due to provision of the protrusion part.

In the foregoing aspect, the cylinder head may include a cylinder head body and a cam housing that is fixed to the upper part of the cylinder head body. The other side wall may include a body side wall, which is a side wall of the cylinder head body, and a housing side wall, which is a side wall of the cam housing. The bearing part may be provided in the connection wall provided in the cam housing. The body side wall may have an opening of the exhaust port and be provided with the protrusion part.

In the above structure, since the body side wall, to which the exhaust pipe is connected, includes the protrusion part, a distance between the protrusion part and the exhaust pipe becomes short, and a quantity of heat received by the protrusion part is increased compared to that in the case where the protrusion part is provided in the housing side wall. Thus, the quantity of heat received by the cylinder head body is increased, and heat is transferred through a part where the cylinder head body and the cam housing are fixed to each other, thereby increasing temperature of the cam housing. Therefore, it is possible to swiftly increase temperature of the bearing part provided in the cam housing.

In the above structure, the protrusion part may be provided in an upper end of the cylinder head body. When manufacturing the cylinder head body, there are instances where polishing is performed along an edge of the upper surface of the cylinder head body to remove burr formed in the edge of the upper surface.

With the above structure, the protrusion part is provided in the upper end of the cylinder head body, and the upper surface of the cylinder head body and the upper surface of the protrusion part become a continuous surface. Therefore, as stated above, by performing deburring along the edge of the upper surface, deburring of the protrusion part is also performed simultaneously. Thus, it is possible to prevent manufacturing man-hours from increasing due to provision of the protrusion part.

In the foregoing aspect, the protrusion part may be provided continuously from one end to the other end of the other side wall in the cylinder arrangement direction. In the above structure, the protrusion part is provided continuously from one end to the other end of the other side wall of the cylinder head in the cylinder arrangement direction. Therefore, an area for receiving radiant heat from the exhaust pipe becomes large.

Further, radiant heat from the exhaust pipe is blocked by the protrusion part that is continuously provided from one end to the other end in the cylinder arrangement direction. Therefore, it is possible to make the protrusion part work as an insulator, thereby reducing a heat input to a part that is hidden behind the protrusion part when seen from the exhaust pipe side.

Hence, with the foregoing structure, it is possible to increase a quantity of heat received by the cylinder head and increase temperature of the bearing part more swiftly. At the same time, it is possible to suppress an increase in temperature of the part hidden behind the protrusion part when seen from the exhaust pipe side, and a member located in that part.

In the foregoing aspect, the protrusion part may have a plate shape in which a thickness is smaller than a length and a width. The length is a dimension in the cylinder arrangement direction, the width is a height from the other side wall, and the thickness is a dimension in a direction perpendicular to both a direction of the length and a direction of the width.

With the above structure, it is possible to suppress an increase in a volume of the protrusion part while increasing an area of a confronting surface that faces the exhaust pipe. Therefore, it is possible to improve heat receiving efficiency of the protrusion part and swiftly increase temperature of the bearing part while suppressing an increase in a weight of the cylinder head.

In the foregoing aspect, the protrusion part may have a thinned part, a thickness of which is smaller than the rest of the part of the protrusion part.

With the above structure, it is possible to suppress an increase in volume.

In the foregoing aspect, the protrusion part may be provided so as to project from the other side wall and surround the exhaust pipe. Also, the protrusion part may be provided so as to surround an entire circumference of the exhaust pipe.

With the above structure, the protrusion part is also able to receive radiant heat, and effects similar to those of the foregoing aspect are still obtained.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
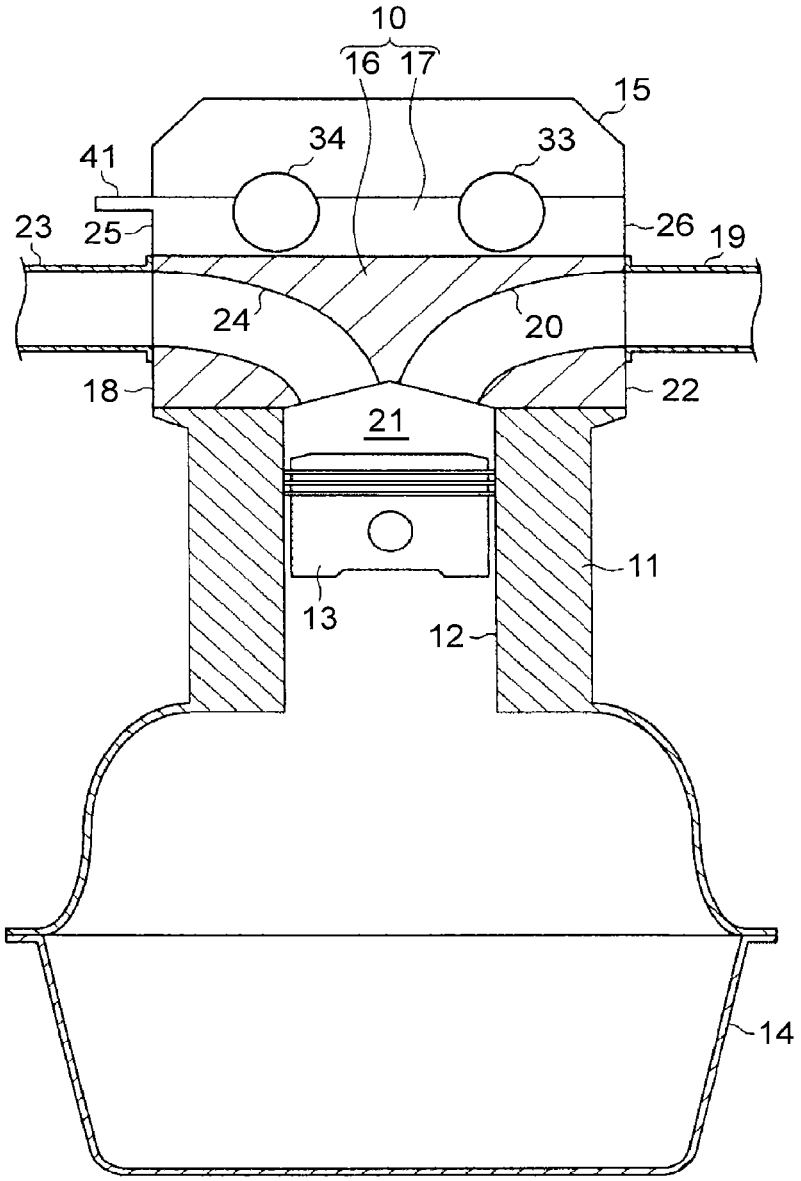
FIG. 1 is a partial sectional view schematically showing an internal combustion engine having a cylinder head as an embodiment.

An embodiment of a cylinder head is explained with reference to FIG. 1 to FIG. 10C. As shown in FIG. 1, in an internal combustion engine provided with a cylinder head 10, a cylinder block 11 is fixed to the bottom of the cylinder head 10. The cylinder block 11 is provided with a plurality of cylinders 12, and each of the cylinders 12 is lined up in the depth direction in FIG. 1. In each of the cylinders 12, a piston 13 is housed so as to move up and down.

An oil pan 14, which stores oil, is fixed to a lower part of the cylinder block 11. A head cover 15, which covers the top of the cylinder head 10, is fixed to an upper part of the cylinder head 10.

The cylinder head 10 is made from a cylinder head body 16 fixed to an upper part of the cylinder block 11, and a cam housing 17 fixed to an upper part of the cylinder head body 16. In the cylinder head body 16, a left side wall 18 located on the left side in FIG. 1, and a right side wall 22 located on the right side in FIG. 1 extend along a cylinder arrangement direction (a depth direction of the sheet in FIG. 1), respectively. An exhaust port 24 is open in the left side wall 18, and an intake port 20 is open in the right side wall 22.

An intake manifold 19 is connected with a part where the intake port 20 is open in the right side wall 22 of the cylinder head body 16. Thus, the intake manifold 19 communicates with a combustion chamber 21 through the intake port 20. The combustion chamber 21 is defined and formed by a lower surface of the cylinder head body 16, the cylinder 12, and an upper surface of the piston 13. Therefore, air flowing inside the intake manifold 19 is supplied to the combustion chamber 21 through the intake port 20.

An exhaust manifold 23 is connected with a part where the exhaust port 24 is open in the left side wall 18 of the cylinder head body 16. Thus, the exhaust manifold 23 communicates with the combustion chamber 21 through the exhaust port 24. Hence, exhaust gas is discharged from the combustion chamber 21 to the exhaust manifold 23 through the exhaust port 24.

Figure 2:
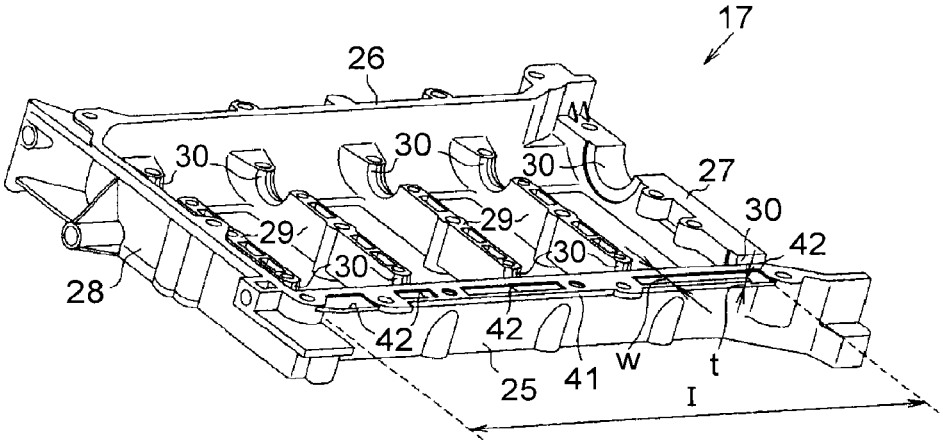
FIG. 2 is a perspective view of a cam housing according to the embodiment.

As shown in FIG. 2, the cam housing 17 includes a left side wall 25 and a right side wall 26 that extend in the cylinder arrangement direction (the horizontal direction in FIG. 2). The side walls 25, 26 are connected with each other by a front wall 27 and a rear wall 28. A plurality of support walls 29 are arranged between the left side wall 25 and the right side wall 26. The support walls 29 extend in a direction that is the same as the direction in which the front wall 27 and the rear wall 28 extend, and connect the side walls 25, 26 with each other. In the front wall 27 and each of the support walls 29, two semicircular recessed parts 30 are provided.

Figure 3:
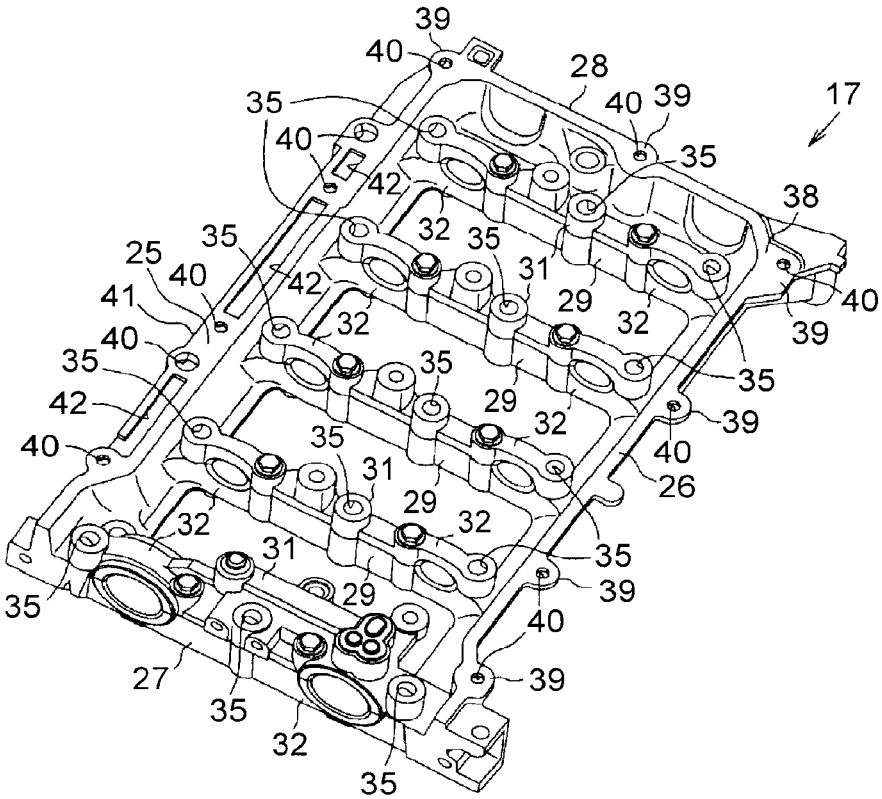
FIG. 3 is a perspective view of the cam housing according to the embodiment, seen from another angle.

As shown in FIG. 3, a cam cap 31 is fixed to the front wall 27 and each of the support walls 29 by bolts. The cam cap 31 includes semicircular recessed parts that are provided at positions facing the recessed parts 30 formed in the front wall 27 and each of the support walls 29, respectively. The recessed parts are symmetrical to the recessed parts 30, respectively. Therefore, in a state where the cam caps 31 are assembled, bearing parts 32 having circular journal holes are formed in the front wall 27 and the support walls 29 of the cam housing 17. This means that the front wall 27 and each of the support walls 29 correspond to connection walls. An intake cam shaft or an exhaust cam shaft is inserted through each of the bearing parts 32. Specifically speaking, an intake cam shaft 33 is inserted through the bearing parts 32 located on the right side wall 26 side, out of the bearing parts 32. An exhaust cam shaft 34 is inserted through the bearing parts 32 located on the left side wall 25 side, out of the bearing parts 32. Thus, as shown in FIG. 1, the intake cam shaft 33 and the exhaust cam shaft 34 are supported by the cam housing 17 so as to rotate. Lubrication oil for lubricating each of the cam shafts 33, 34 is supplied to the bearing parts 32.

Figure 4:
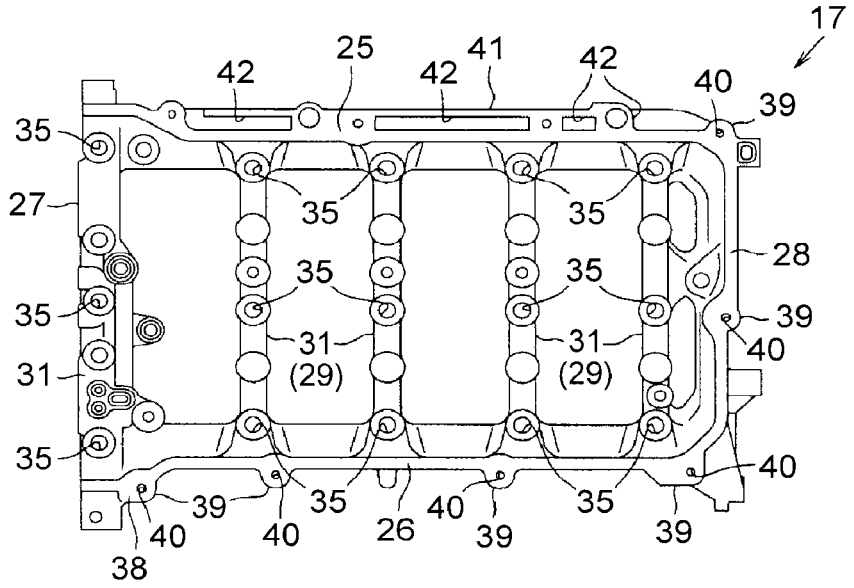
FIG. 4 is a top view of the cam housing according to the embodiment.
Figure 5:
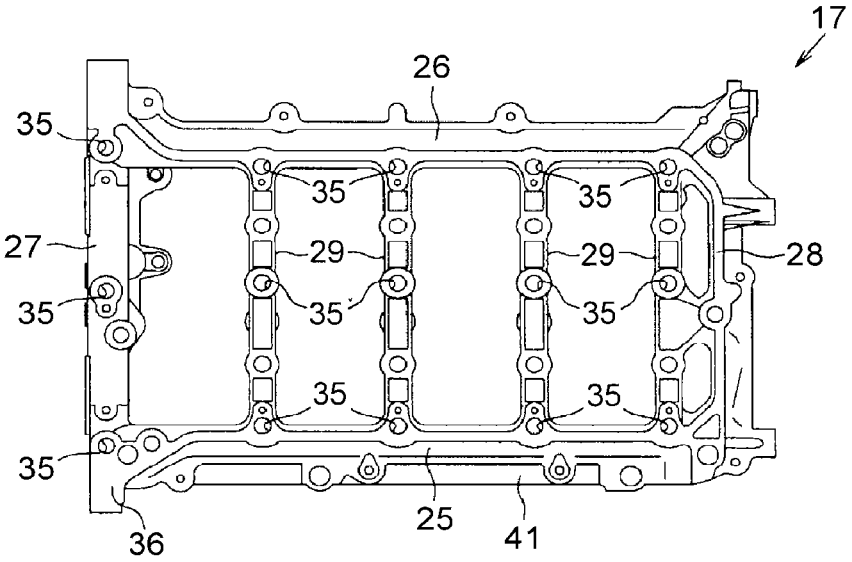
FIG. 5 is a bottom view of the cam housing according to the embodiment.

As shown in FIG. 3 and FIG. 4, a plurality of bolt holes 35 extending in the vertical direction (the depth direction on the sheet in FIG. 4) are formed in each of the support walls 29 of the cam housing 17 and each of the cam caps 31. As shown in FIG. 5, each of the bolt holes 35 is open on a bottom surface 36 of the cam housing 17. A bolt is inserted through each of the bolt holes 35 for assembling the cam housing 17 and the cylinder head body 16 to each other.

Figure 6:
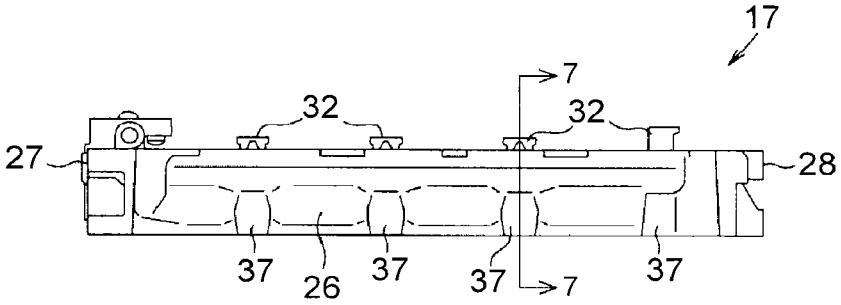
FIG. 6 is a right side view of the cam housing according to the embodiment.
Figure 7:
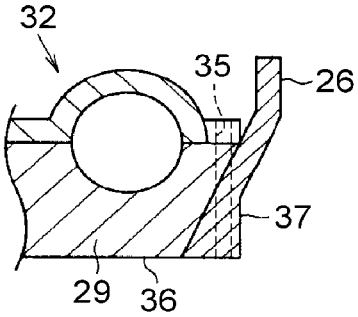
FIG. 7 is a sectional view taken along the line 7-7 in FIG. 6.
Figure 8:
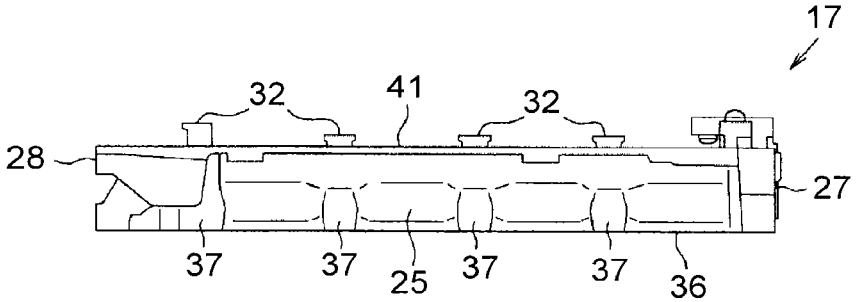
FIG. 8 is a left side view of the cam housing according to the embodiment.

In the cam housing 17, each of the side walls 25, 26 is tilted with respect to the vertical direction so that a distance between the side walls 25, 26 becomes shorter towards the bottom in the vertical direction (a deep side from the sheet in FIG. 4). Therefore, as shown in FIG. 4 to FIG. 7, in the bolt hole 35 provided in a connecting part of the support wall 29 with the right side wall 26, an upper opening is located on the support wall 29, but a lower opening is located on the right side wall 26. Also, as shown in FIG. 6 and FIG. 7, a generally columnar bolt wall part 37 is provided in a lower part of the right side wall 26. The bolt wall part 37 projects from the right side wall 26 and extends downwardly in the vertical direction along the right side wall 26. The bolt hole 35 passes through the bolt wall part 37 of the right side wall 26 and is open on the bottom surface 36. As shown in FIG. 8, the bolt wall part 37 is also provided in the left side wall 25 similarly to the right side wall 26. Thus, the bolt hole 35 provided in a connecting part of the support wall 29 with the left side wall 25 is open on the bottom surface 36 through the bolt wall part 37 of the left side wall 25.

As shown in FIG. 3 and FIG. 4, generally circular flange parts 39 are provided in an upper surface 38 of the right side wall 26 and the rear wall 28 of the cam housing 17. The flange parts 39 project to an outer side of the cam housing 17. A bolt insertion hole 40 is formed in each of the flange parts 39. Then, the head cover 15 is fastened to the flange parts 39 by bolts inserted through the bolt insertion holes 40.

As shown in FIG. 3 and FIG. 8, a protrusion part 41 is provided in the left side wall 25 of the cam housing 17. The protrusion part 41 projects from the left side wall 25 and extends in the cylinder arrangement direction from one end to the other end of the left side wall 25 in the cylinder arrangement direction, in other words, from a part connected with the front wall 27 to a part connected with the rear wall 28. The protrusion part 41 is provided in an upper end of the left side wall 25, and the upper surface of the protrusion part 41 and the upper surface of the left side wall 25 are continuous.

As shown in FIG. 2, the protrusion part 41 has a plate shape in which a thickness t is smaller than a length l and a width w. The thickness t is a dimension in a direction perpendicular to both of a direction of the length and a direction of the width, the length l is a dimension in the cylinder arrangement direction, and the width w is a height from the left side wall 25. In the protrusion part 41, a thinned part 42 is formed, which is thinned from the upper surface side and has a thickness t that is smaller than that of the rest of the part of the protrusion part 41. A lower surface of the protrusion part 41 has a flat plate shape. In the protrusion part 41, bolt insertion holes 40 are formed, which go through the protrusion part 41 from the upper surface to the bottom surface. Bolts are inserted into the bolt insertion holes 40 when fastening the head cover 15.

The cam housing 17 having the above-mentioned structure is fixed to the cylinder head body 16 so that the right side wall 26 of the cam housing 17 is located above the right side wall 22 of the cylinder head body 16, and the left side wall 25 of the cam housing 17 is located above the left side wall 18 of the cylinder head body 16 as shown in FIG. 1. The left and right side walls 18, 22 of the cylinder head body 16, and the left and right side walls 25, 26 of the cam housing 17 form a pair of side walls extending along the cylinder arrangement direction of the cylinder head 10, in short, a right side wall and a left side wall of the cylinder head 10. As stated earlier, the exhaust port 24 is open on the left side wall 18 of the cylinder head body 16, and the exhaust manifold 23 communicating with the opening is connected with the left side wall 18. Therefore, the protrusion part 41 provided in the left side wall 25 of the cam housing 17 that is fixed to the upper part of the cylinder head body 16 is located above the exhaust manifold 23, and a lower surface of the protrusion part 41 faces the exhaust manifold 23. The left side wall 18 of the cylinder head body 16 is an example of a body side wall of the cylinder head 10, and the left side wall 25 of the cam housing 17 is an example of a housing side wall of the cylinder head 10.

Next, operations of the cylinder head 10 according to this embodiment are explained with reference to FIG. 9 and FIG. 10. Once the exhaust manifold 23 is heated by exhaust gas at high temperature passing inside the exhaust manifold 23, heat is radiated from a wall surface of the exhaust manifold 23.

Figure 9:
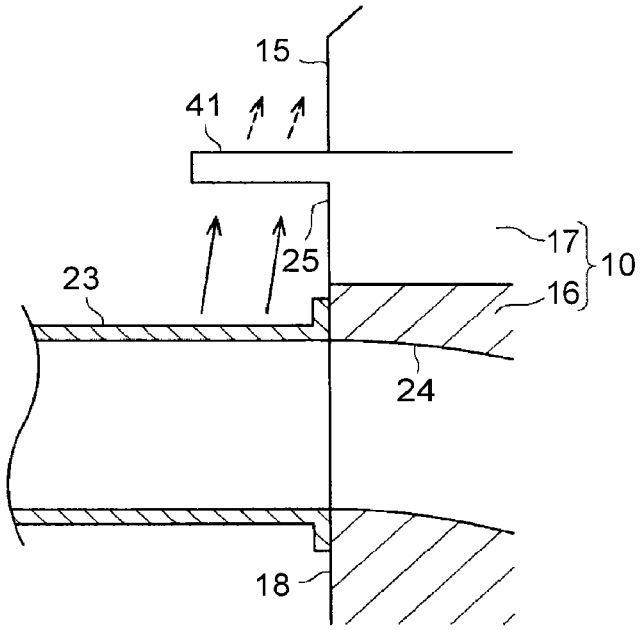
FIG. 9 is a schematic view showing a form of receiving heat at a protrusion part according to the embodiment.

As shown in FIG. 9, the protrusion part 41 with the lower surface facing the exhaust manifold 23 is provided in the left side wall of the cylinder head 10, or the left side wall 25 of the cam housing 17 to be more specific. Therefore, the lower surface works as a confronting surface that receives radiant heat, and radiant heat of the exhaust manifold 23 is absorbed by the protrusion part 41. Thus, compared to a cylinder head 10 without the protrusion part 41, a quantity of heat received from the exhaust manifold 23 becomes larger.

The bearing parts 32 are provided in the front wall 27 and the support walls 29 that are provided between the left side wall 25 and the right side wall 26 of the cam housing 17 and connect the both side walls 25, 26 with each other. Therefore, the bearing parts 32 and the left side wall 25 are linked to each other through the front wall 27 and the support walls 29. Therefore, heat received by the protrusion part 41 provided in the left side wall 25 is transferred to the bearing parts 32 easily.

Further, the bearing parts 32 are provided in the cam housing 17, and the protrusion part 41 is provided in the left side wall 25 of the cam housing 17. Therefore, a distance between the protrusion part 41, which receives radiant heat, and the bearing parts 32 becomes shorter compared to that in a case where the protrusion part 41 is provided in the cylinder head body 16.

In a process of manufacturing the cylinder head 10, there are instances where burr is formed in an edge of the upper surface 38 of the cylinder head 10. When burr is formed, it is necessary to remove the burr by polishing the upper surface 38 of the cylinder head 10. For example, the following method may be used as a deburring method.

Figure 10A:
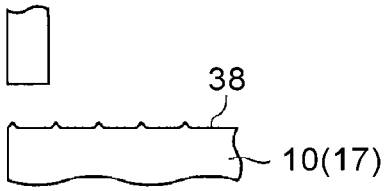
FIG. 10A is a schematic view showing an example of a method for processing a upper surface of the cam housing according to the embodiment.
Figure 10B:
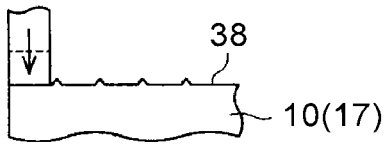
FIG. 10B is a schematic view showing the example of the method for processing the upper surface of the cam housing according to the embodiment.
Figure 10C:
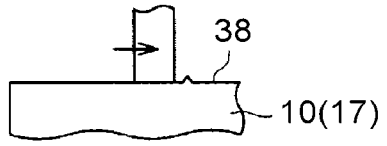
FIG. 10C is a schematic view showing the example of the method for processing the upper surface of the cam housing according to the embodiment.

As shown in FIG. 10A, a polishing machine is brought to face a part of the upper surface 38 of the cylinder head 10. Next, as shown in FIG. 10B, the machine is pushed against an edge of the upper surface 38 of the cylinder head 10, and polishing is performed. Then, as shown in FIG. 10C, the edge of the upper surface 38 is polished throughout an entire circumference while moving the machine along the upper surface 38 of the cylinder head 10.

In this embodiment, the protrusion part 41 is provided in an upper end of the left side wall 25 of the cylinder head 10, and the upper surface 38 of the left side wall 25 and the upper surface of the protrusion part 41 are a continuous surface. Therefore, deburring of the protrusion part 41 is also performed simultaneously when the foregoing deburring is carried out.

Since the protrusion part 41 is provided continuously from one end to the other end of the left side wall 25 of the cylinder head 10 in the cylinder arrangement direction, an area of the confronting surface of the protrusion part 41, or an area of the lower surface that receives radiant heat of the exhaust manifold 23 increases. Also, radiant heat from the exhaust manifold 23 is blocked by the protrusion part 41 that is provided continuously from one end to the other end of the left side wall 25 in the cylinder arrangement direction. Therefore, it is possible to make the protrusion part 41 serve as an insulator, and a heat input to the head cover 15, which is hidden behind the protrusion part 41 when seen from the exhaust manifold 23 side, is reduced as shown in FIG. 9.

The protrusion part 41 has a plate shape in which the thickness t is smaller than the length l and the width w of the protrusion part 41. Therefore, the area of the confronting surface that faces the exhaust manifold 23 increases, while suppressing an increase in a volume of the protrusion part 41.

Since the thinned parts 42 are provided in the upper surface 38 of the protrusion part 41, an increase in the volume of the protrusion part 41 is suppressed. According to the embodiment explained so far, the following effects are obtained.

As the first effect, the protrusion part 41 is able to receive radiant heat from the exhaust manifold 23, and it is thus possible to increase a quantity of heat received compared to that of a cylinder head 10 without the protrusion part 41. Since the bearing parts 32 are provided in the front wall 27 and the support walls 29, the bearing parts 32 and the left side wall 25, in which the protrusion part 41 is provided, are connected with each other through the front wall 27 and the support walls 29. Therefore, heat received by the protrusion part 41 provided in the left side wall 25 is easily transferred to the bearing parts 32. Therefore, it is possible to swiftly increase temperature of the bearing parts 32 provided in the cylinder head 10. Accordingly, temperature of lubricating oil supplied to the bearing parts 32 is increased, and viscosity of the lubricating oil is reduced, thereby reducing cam friction.

As the second effect, since the protrusion part 41 is provided in the left side wall 25 of the cam housing 17 in which the bearing parts 32 are provided, it is possible to swiftly increase temperature of the bearing parts 32 provided in the cam housing 17, thereby reducing cam friction.

As the third effect, the protrusion part 41 is provided in the upper end of the left side wall 25, and the upper surface 38 of the left side wall 25 and the upper surface of the protrusion part 41 are a continuous surface. Thus, it is possible to perform deburring of the protrusion part 41 simultaneously when deburring is carried out. Therefore, it is possible to prevent manufacturing man-hours from increasing due to provision of the protrusion part 41.

As the fourth effect, the protrusion part 41 is continuously provided from one end to the other end of the left side wall 25 of the cam housing 17 in the cylinder arrangement direction. Therefore, it is possible to increase an area for receiving radiant heat of the exhaust manifold 23. At the same time, the protrusion part 41 is able to work as an insulator and reduce a heat input to the head cover 15 that is hidden behind the protrusion part 41 when seen from the exhaust manifold 23 side. Therefore, it is possible to increase a quantity of heat received by the cylinder head 10, thereby increasing temperature of the bearing parts 32 more swiftly, and also suppressing an increase in temperature of the head cover 15.

As the fifth effect, since the protrusion part 41 is in a plate shape, it is possible to improve heat receiving efficiency of the protrusion part 41, and thus increase the temperature of the bearing parts 32 more swiftly, while suppressing an increase in a weight of the cylinder head 10.

The foregoing embodiment may be changed as stated below and carried out. The lower surface of the protrusion part 41 may be uneven in order to increase an area of the confronting surface. The shape of the protrusion part 41 is the plate shape in which the thickness t is smaller than the length l and the width w. However, this dimensional relationship may be changed as appropriate. For example, the thickness t may be larger than either one of the length l and the width w. With these structures, it is still possible to obtain the first to fourth effects stated above.

In the left side wall 25 of the cam housing 17, the protrusion part 41 may be partially divided in the cylinder arrangement direction. In this case, it is preferred that the protrusion part 41 is provided on an outer side of a part of the left side wall 25, which is connected with the bearing part 32. With this structure, it is still possible to obtain the first to third effects explained above.

The protrusion part 41 may be provided in a part lower than the upper end of the left side wall of the cylinder head 10. With this structure, it is still possible to obtain the first and second effects. The front wall 27 and the support walls 29, in which the bearing parts 32 are provided, and the side walls 25, 26 may not be connected with each other directly. For example, connection members may be provided between the front wall 27 and the support walls 29, and the side walls 25, 26, and the front wall 27 and the support walls 29, and the side walls 25, 26 may be connected with each other through the connection members. In this case, the front wall 27 and the support walls 29, as well as the connection members are provided between the side walls 25, 26, and structure connection walls that connect both of the side walls 25, 26 with each other.

In the cylinder head 10, the protrusion part 41 is provided in the left side wall 25 of the cam housing 17. However, a protrusion part, which has a confronting surface that faces the exhaust pipe, may be provided in the left side wall 18 of the cylinder head body 16. In this structure, a distance between the protrusion part and the exhaust pipe becomes short. Therefore, a quantity of heat received by the protrusion part becomes larger than that in the case where the protrusion part is provided in the housing side wall. Thus, a quantity of heat received by the cylinder head body 16 is increased, and heat is transferred through a part where the cylinder head body 16 and the cam housing 17 are fixed to each other, thereby increasing temperature of the cam housing 17. With this structure, it is possible to increase temperature of the bearing parts 32 provided in the cylinder head 10, and the first effect stated above is still obtained. A position where the protrusion part is provided is not limited to a position above the exhaust manifold 23, and may be a position below the exhaust manifold 23.

When manufacturing the cylinder head body 16, there are instances where polishing is performed along an edge of an upper surface of the cylinder head body 16 to remove burr formed on the edge of the upper surface. In the above structure, by providing the protrusion part in an upper end of the cylinder head body 16, the upper surface of the cylinder head body 16 and an upper surface of the protrusion part become a continuous surface. Therefore, by performing deburring along the edge of the upper surface as stated above, deburring of the protrusion part is also done at the same time. Therefore, it is possible to prevent manufacturing man-hours from increasing due to provision of the protrusion part in the cylinder head body 16.

In the cylinder head 10, the cylinder head body 16 and the cam housing 17 may be formed integrally with each other. This means that the cylinder head 10 does not have to be separated into the cylinder head body 16 and the cam housing 17. In this case, the protrusion part may be provided on a side wall of the cylinder head 10 in which the opening of the exhaust port 24 is formed, and the protrusion part may project from the side wall and extend in the cylinder arrangement direction. With this structure, it is still possible to obtain an effect similar to the first effect.

Figure 11:
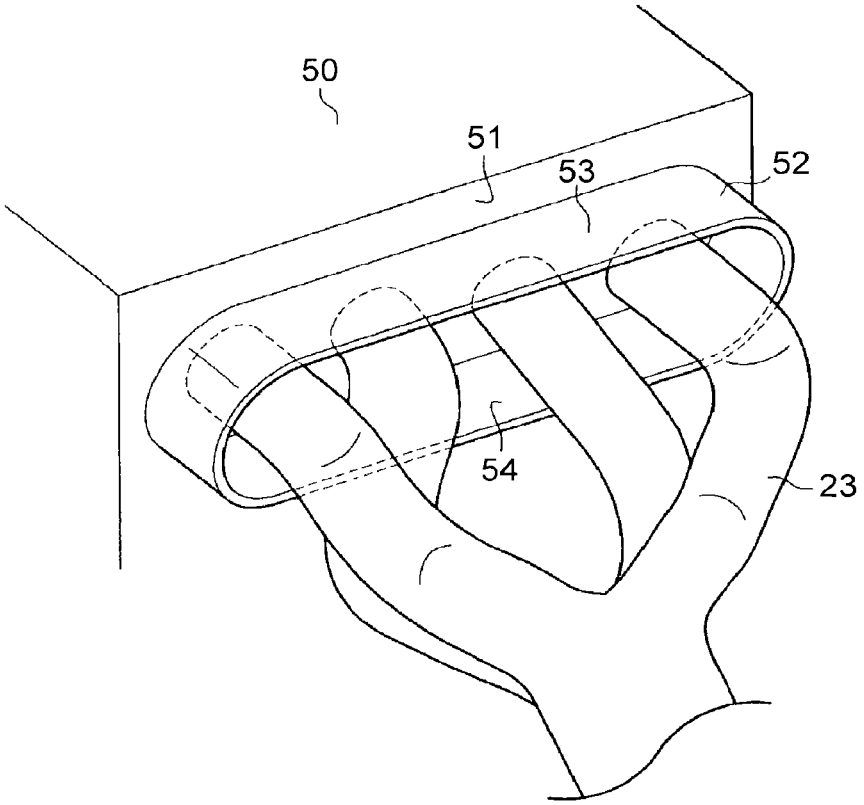
FIG. 11 is a perspective view showing a structure of a cylinder head as another embodiment.

The shape of the protrusion part 41 is not limited to that described in the foregoing embodiment, and may be changed as appropriate. For example, a structure shown in FIG. 11 may be used. As shown in FIG. 11, an exhaust manifold 23 is connected with a side wall 51 in which an exhaust port is open, out of a pair of side walls of a cylinder head 50 extending in the cylinder arrangement direction.

In the cylinder head 50, a protrusion part 52 is provided, which projects from the side wall 51 of the cylinder head 50 so as to surround an exhaust manifold 23. In the protrusion part 52, an upper part 53 and a lower part 54 extend along the cylinder arrangement direction. An inner peripheral surface of the protrusion part 52 faces the exhaust manifold 23 throughout the entire circumference. This means that the entire inner peripheral surface of the protrusion part 52 works as a confronting surface.

With this structure, the protrusion part 52 is able to receive radiant heat, and it is thus possible to obtain an effect similar to the first effect stated above. In the above structure, the protrusion part may not surround the entire circumference of the exhaust pipe, and may have a shape that is partially divided in the circumferential direction.

The exhaust manifold 23 may be formed integrally with the cylinder head 10. In this case, it is only necessary to provide a protrusion part on a side wall of the cylinder head 10 in which an exit of the exhaust manifold 23 is open, and the protrusion part protrudes from the side wall, extends in a cylinder arrangement direction, and has a confronting surface that faces an exhaust pipe connected with the side wall.

What is claimed is:

1. A cylinder head comprising:

a pair of side walls extending along a cylinder arrangement direction;

a connection wall that is provided between the pair of side walls and connects both of the side walls with each other;

a bearing part that is provided in the connection wall and supports a cam shaft so that the cam shaft is able to rotate;

an intake port that is open in one side wall out of the pair of side walls; and an exhaust port that is open in the other side wall, wherein the cylinder head includes a cylinder head body and a cam housing that is fixed to an upper part of the cylinder head body, the other side wall includes a body side wall, which is a side wall of the cylinder head body, and a housing side wall, which is a side wall of the cam housing, the bearing part is provided in the connection wall provided in the cam housing, and the exhaust port is open in the body side wall, the housing side wall is provided with a protrusion part, which projects from the housing side wall, extends along the cylinder arrangement direction, and has a confronting surface that faces an exhaust pipe connected with the other side wall, the protrusion part is provided so as to project from the housing side wall and surround an entire circumference of the exhaust pipe, and the protrusion part is formed on the housing side wall integrally.

2. The cylinder head according to claim 1, wherein the protrusion part is formed in an upper end of the housing side wall.

3. The cylinder head according to claim 1, wherein the body side wall has an opening of the exhaust port.

4. The cylinder head according to claim 1, wherein a portion of the protrusion part is provided continuously from a first end to a second end of the housing side wall in the cylinder arrangement direction.

5. The cylinder head according to claim 1, wherein a portion of the protrusion part has a plate shape in which a thickness is smaller than a length and a width, the length being a dimension in the cylinder arrangement direction, the width being a height from the housing side wall, and the thickness being a dimension in a direction perpendicular to both a direction of the length and a direction of the width.

6. The cylinder head according to claim 1, wherein the protrusion part has a thinned part, a thickness of which is smaller than the rest of the part of the protrusion part.

7. The cylinder head according to claim 1, wherein an upper part of the protrusion part extending along the cylinder arrangement direction is disposed directly above the exhaust pipe and a lower part of the protrusion part extending along the cylinder arrangement direction is disposed directly below the exhaust pipe such that the confronting surface of the protrusion part directly faces and overlaps the entire circumference of the exhaust pipe, the confronting surface being an entire inner peripheral surface of the protrusion part.

* * * * *